United States Patent [19]

Kondo et al.

[11] 4,203,278

[45] May 20, 1980

[54] ALARM ELECTRONIC TIMEPIECE

[75] Inventors: Kenichi Kondo; Shojiro Komaki, Tokyo, Japan

[73] Assignee: Kabushiki Kaisha Daini Seikosha, Japan

[21] Appl. No.: 851,787

[22] Filed: Nov. 15, 1977

[30] Foreign Application Priority Data

Nov. 15, 1976 [JP] Japan ..... 51-137162

[51] Int. Cl.[2] ..... G04B 23/10

[52] U.S. Cl. ..... 368/73; 368/245; 368/251; 368/109

[58] Field of Search ..... 58/16 R, 19 R, 21.12, 58/38, 57.5; 84/DIG. 11, DIG. 18, DIG. 23, DIG. 24, 340–384 E

[56] References Cited

U.S. PATENT DOCUMENTS

| | | | |
|---|---|---|---|
| 3,842,702 | 10/1974 | Tsundoo | 84/DIG. 11 |
| 4,060,973 | 12/1977 | Martino | 58/19 R |
| 4,068,461 | 1/1978 | Fassett et al. | 58/57.5 |
| 4,074,516 | 2/1978 | Kondo | 58/57.5 |

*Primary Examiner*—J. V. Truhe
*Assistant Examiner*—Leonard W. Pojunas, Jr.
*Attorney, Agent, or Firm*—Robert E. Burns; Emmanuel J. Lobato; Bruce L. Adams

[57] ABSTRACT

An alarm electronic timepiece comprising a timepiece circuit, a display for displaying time, an alarm for generating an alarm sound at an alarm time, a memory circuit for memorizing the alarm time and an alarm control circuit for controlling the tone quality and a sound volume of the alarm sound. The alarm control circuit includes externally operable switches of the timepiece which are operable for controlling the alarm sound and which are also operable for correcting time.

5 Claims, 2 Drawing Figures

ALARM ELECTRONIC TIMEPIECE

BACKGROUND OF THE INVENTION

The present invention relates to an alarm electronic timepiece and more particularly to an improvement in circuitry for controlling a tone quality and a sound volume of a timepiece alarm.

Sound emitting bodies of the conventional alarm electronic timepieces are driven by a piezo-electric element, an electromagnetic buzzer or the like at a frequency within an audible frequency band. However, in order to use the piezo-electric element and the electromagnetic buzzer as a sounding body in an electronic timepiece, there are several difficulties and insufficiencies with respect to miniaturizaton and power consumption which must be overcome Namely, the piezo-electric element type is superior with respect to low power consumption but inferior with respect to the tone quality. On the contrary, as for the electromagnetic buzzer, the tone quality is superior and a comfortable electronic sound is realized, moreover the tone quality and the sound volume can be varied by the modulation of the driving signal. However, the power consumption of the electromagnetic buzzer is larger than the piezo-electric element type. As for the conventional type, the tone quality and the sound volume thereof were inferior since the ability to adjust the sound volume as necessary is not provided and thus the alarm function did not work well.

SUMMARY OF THE INVENTION

Therefore, it is an object of the present invention to provide the alarm electronic timepiece which is capable of having the alarm sound volume adjusted as necessary and which eliminates the above mentioned insufficiencies of the conventional type alarm timepiece.

Another object of the present invention is to provide an easily adjustable and inexpensive alarm electronic timepiece by using the conventional externally operable switches necessary for the timepiece also as the sound volume adjusting and operation member.

DESCRIPTION OF THE PREFERRED EMBODIMENT

Figure 1:
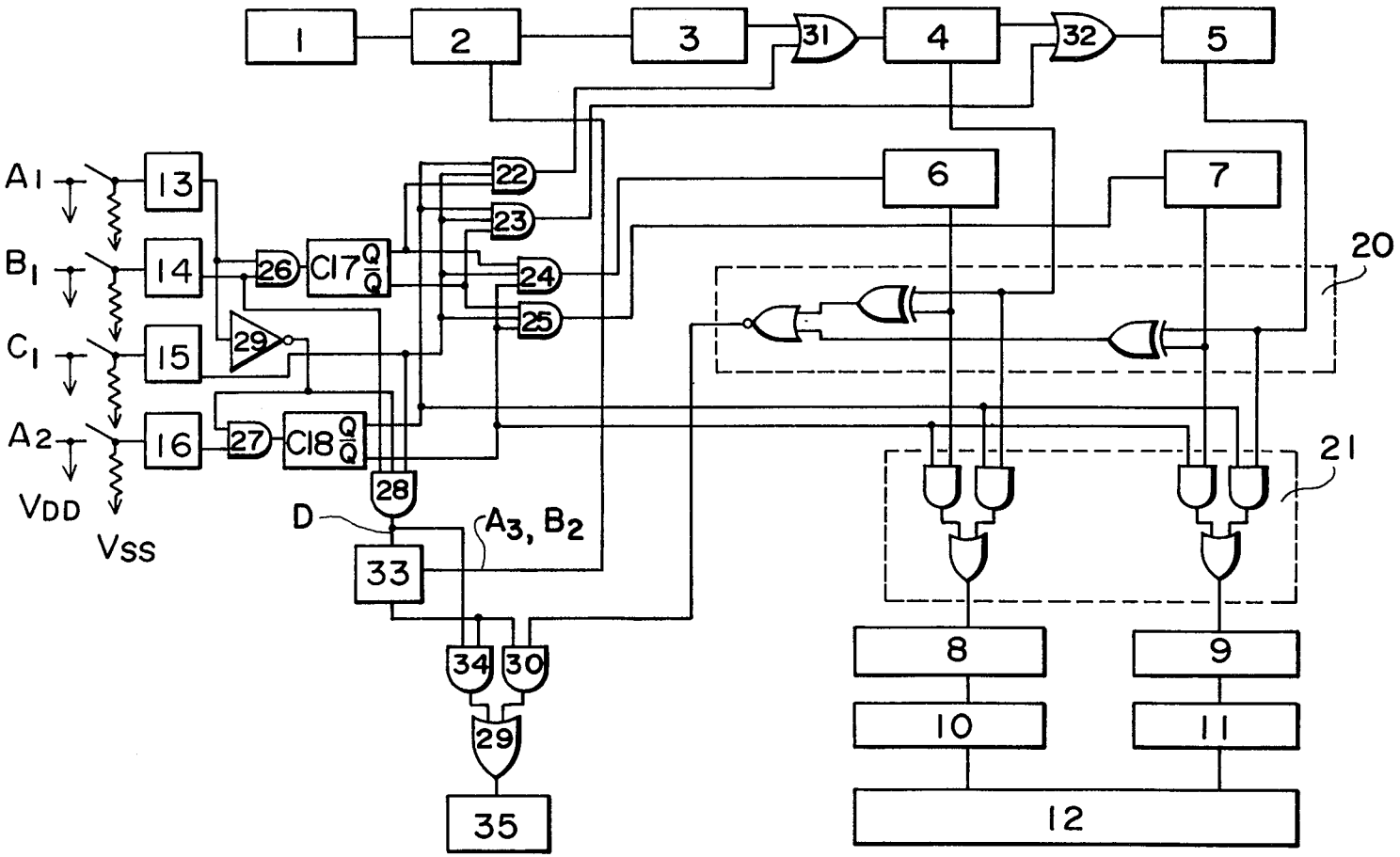
FIG. 1 is a circuit diagram of the alarm electronic timepiece according to the present invention.

Referring now to the operation of the present invention. FIG. 1 is a block circuit diagram of the digital alarm electronic timepiece embodying the present invention.

The reference signal of an oscillating circuit 1 is divided by a dividing circuit 2 and a minute signal from a second counting circuit 3 is fed to a minute counting circuit 4. The minute counting circuit 4 produces hours signal and an hour counting circuit 5 counts an hour. A memory channel circuit of an alarm is composed of a minute memory circuit 6 and an hour memory circuit 7 and memorizes a setting or alarm time. A coincidence detecting circuit 20 detects coincidence of the setting time and the normal or present time kept by counters 4 and 5. The display of the present time or the alarm memory content is controlled by a switching circuit 21 and is changed-over by the output signals Q and $\underline{Q}$ of a flipflop circuit 18 which is operated by a mode selecting switch $A_2$. The output from the switching circuit 21 is converted to a segment signal by decoders 8 and 9, and a time or a setting time is displayed on a display device 12 by drivers 10 and 11. An unlock switch $A_1$ is a safety switch to prevent a mis-operation. A switch $B_1$ is a figure selecting switch to select a figure for time correction and setting or alarm time adjustment. A switch $C_1$ is a set switch to feed a signal to the selected figure. Usually, all the switches are in the OFF state.

Minute correction of present time is achieved as follows.

By operation of the mode selecting switch $A_2$ ON and OFF, the time display mode is selected wherein the state the output Q of the flipflop circuit 18 is "1". Then the unlock switch $A_1$ is kept in the ON state and the switch $B_1$ is ON and then OFF operated. When the output of a figure selecting circuit is "1", the minute counting circuit is in the state of selection. Nextly, by operation of the switch $C_1$ ON and OFF a correction pulse signal is produced from an AND circuit 22 and fed to the minute counting circuit 4. Thus the time is corrected. After the time correction, the unlock switch $A_1$ is restored to the OFF state to prevent mis-operation. While when the output from an AND circuit 28 is "1" by the switches $B_1$ and $C_1$ being simultaneously in the ON state, a "1" output is fed to a sound volume adjusting circuit 33 and the sound volume is adjusted.

The structure of the sound volume adjusting circuit 33 is capable of selecting the duty cycle of the audio frequency signal of the divided signal from the divided circuit 2. The dividing signal of the selected duty cycle is fed to an alarm driving circuit 35 via an AND circuit 34 and an OR circuit 29 while the switches $B_1$ and $C_1$ are in the ON state and then an alarm sound is generated. When the output from the coincidence detecting circuit 20 is "1", a driving signal of the selected duty cycle is fed to the driving circuit 35 via an AND circuit 30 and the OR circuit 29 and the alarm sound is generated.

Figure 2:
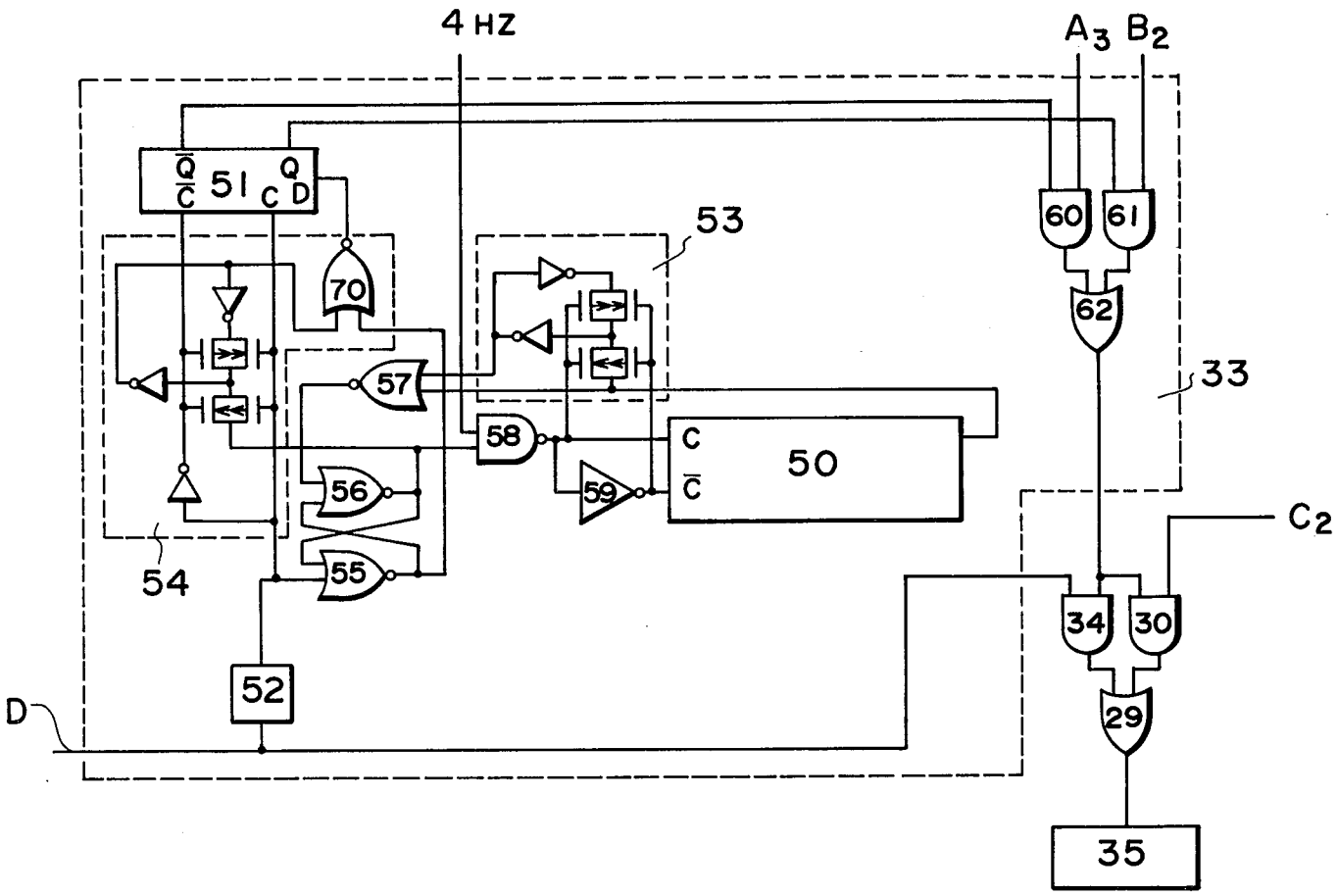
FIG. 2 is a circuit diagram of the sound volume adjusting circuit of the electronic timepiece according to the present invention.

FIG. 2 is a sound volume adjusting circuit diagram embodying the present invention.

If the switches $B_1$ and $C_1$ are simultaneously ON when the unlock switch $A_1$ under the normal operating state is OFF, the output of AND circuit 28 is fed through the lead D to a latch circuit 52 and is fed directly to the AND circuit 34. By the simultaneous ON operation of the switches $B_1$ and $C_1$ a pulse signal is produced from the latch circuit 52 and fed to a NOR circuit 55 comprising part of an R-S flipflop, and then the output from a NOR circuit 56 becomes "1". Therefore a 4Hz of the dividing circuit 2 is produced from an AND circuit 58 and a two second counting circuit 50 detects when two seconds have passed since the two second counting circuit 50 is ON. The output from the two second counting circuit 50 is fed to a latch circuit 53 and a thin or narrow pulse signal is produced from a NOR circuit 57. The thin pulse is fed to the NOR circuit 56 to reset the flipflop. In case the switches $B_1$ and $C_1$ are simultaneously ON while the NOR circuit 56 output is "1" (about two seconds), the output Q of the D-type flip flop is kept "1" since the output from a NOR circuit 70 of a latch circuit 54 has already become a "1" level data signal applied to the D-type flipflop circuit 51. Therefore a gate comprised of an AND circuit 61 is opened and signal $B_2$ becomes the driving signal of the alarm driving signal 35.

Signal $B_2$ is a 4096Hz driving signal from the dividing circuit 2 the duty cycle of which is modulated into $\frac{1}{8}$.

In case the switches $B_1$ and $C_1$ are ON again when two seconds have passed since the switches B and C were simultaneously ON, the output from the NOR circuit 70 becomes "0" and the Q output of the D-type flipflop becomes "0" Then a gate comprised of an AND circuit 60 opens and signal $A_3$ is fed to the alarm driving circuit 35 as a driving signal. Signal $A_3$ is a signal of 4096Hz the duty cycle of which is $\frac{1}{2}$. Thus the duty cycles of the signal $A_3$ and the signal $B_2$ are different. Therefore the driving signal corresponding to the signal $B_2$ has less energy than that of signal $A_3$ and so the sound volume of the alarm becomes smaller in the case by driving of the signal $B_2$. The selection between the signal $A_3$ and the signal $B_2$ is memorized by the D-type flipflop circuit 51. The signal $C_2$ applied to the AND circuit 30 is the alarm coincidence signal. So when the alarm time and present time coincide, the signal $C_2$ opens the AND circuit 30 $A_3$ by the signal $A_3$ on the signal $B_2$. A gate comprised of the AND circuit 34 opens while the switches $B_1$ and $C_1$ are simultaneously ON, and the sound volume of the alarm is freely adjustable. On the other hand, in order to change the tone quality of the alarm for the case when the sound volume is constant, substitute the signal $B_2$ with another signal which modulates the 4096 Hz driving signal by 1 or 2 Hz signals by means of an AND gate (not shown). Then an intermittent alarm sound is generated and a tone quality different from that of the signal $A_3$ is obtained.

As discussed above, according to the present invention, the adjustment of the alarm sound volume is possible by employing the operating switches necessary for the timepiece without having to provide a special switch. And an inexpensive alarm with sound volume adjustment is provided without injuring the external appearance of the timepiece. Moreover, the period of driving current flow is limited to adjust the sound volume and thus, the battery life is prolonged. Furthermore, the alarm sound is freely generated at any time simultaneously with the sound volume adjustment.

We claim:

1. An alarm electronic timepiece, comprising: an oscillator circuit for developing a time standard signal; a dividing circuit for dividing the time standard signal and for developing a plurality of divided output signals; a time counting circuit for counting one of the divided output signals and for developing a count representative of present time; a memory circuit for storing a signal representative of an alarm time; a coincidence detecting circuit for detecting coincidence between present time represented by the count developed by said time counting circuit and the signal stored in said memory circuit and representative of the alarm time and for developing an output coincidence signal; a display for displaying present time represented by the count developed by said counting circuit and for displaying alarm time represented by the signal stored in said memory circuit; alarm means responsive to a divided signal developed by said dividing circuit for generating an alarm sound in response thereto; and alarm operating means operable at will and automatically operative in response to the coincidence signal developed by said coincidence detecting circuit for applying one of the divided signals to said alarm means for generating an alarm sound, said alarm operating means includes a plurality of external switches manually operable by a user of the timepiece for selecting among the divided signals by simultaneous operation of at least a pair of said external switches to set the alarm sound generated by said alarm means according to the divided signal selected.

2. An alarm electronic timepiece according to claim 1, wherein said alarm operating means is further comprised of a counting circuit for counting a predetermined time interval in response to operation of said external switches, and selecting means for selecting another divided output signal from said dividing circuit is response to operation of said external switches within the predetermined time interval to change the alarm sound.

3. An alarm electronic timepiece according to claim 1, wherein said plurality of external switches are time correction switches of the timepiece and are also manually operable for correcting the time kept by the timepiece.

4. An alarm electronic timepiece, comprising: an oscillator circuit for developing a time standard signal; a dividing circuit for dividing the time standard signal and for developing a plurality of divided output signals; a time counting circuit for counting one of the divided output signals and for developing a count representative of present time; a memory circuit for storing a signal representative of an alarm time; a coincidence detecting circuit for detecting coincidence between present time represented by the count developed by said time counting circuit and the signal stored in said memory circuit and representative of the alarm time and for developing an output coincidence signal; a display for displaying present time represented by the count developed by said counting circuit and for displaying alarm time represented by the signal stored in said memory circuit; alarm means responsive to a divided signal developed by said dividing circuit for generating an alarm sound in response thereto; alarm operating means operable at will and automatically operative in response to the coincidence signal developed by said coincidence detecting circuit for applying one of the divided signals to said alarm means for generating an alarm sound; and a plurality of manually operable external switches for correcting time, selecting operating mode and controlling the timepiece display; and wherein said alarm operating means comprises a pair of said plurality of manually operable external switches, circuit means cooperative with said pair of switches for developing an alarm control signal upon simultaneous actuation of said pair of switches, selecting means responsive to said alarm control signal for developing a first selecting signal for a predetermined time interval and for automatically terminating the first selecting signal after the predetermined time interval and for developing a second selecting signal after the first selecting signal is terminated if said pair of switches remain actuated after the predetermined time interval, an alarm enabling gate receptive of a selected divided signal and the alarm control signal and the coincidence signal for applying the selected divided signal to said alarm means in response to either the alarm control signal or the coincidence signal, a first selecting gate receptive of the first selecting signal and a first divided signal for applying the first divided signal to said alarm enabling gate in response to said first selecting signal, and a second selecting gate receptive of the second selecting signal and a second divided signal for applying the second selected signal to said alarm enabling gate in response to said second selecting signal.

5. An alarm electronic timepiece according to claim 4, wherein said selecting means comprises a first flip-flop circuit set by the alarm control signal, a second flip-flop circuit set by the alarm enabling signal to develop the first selecting signal as an output signal, timing means enabled by the output of said first flip-flop circuit for developing an output signal to reset said first flop-flop circuit after the predetermined time interval has elapsed, said reset first flip-flop disenabling said second flip-flop circuit to terminate the first selecting signal, and means responsive to the output of said reset first flip-flop circuit and the alarm control signal for enabling said second flip-flop circuit to develop the second selecting signal as an output signal in response to the alarm control signal after the predetermined time interval has elapsed.

* * * * *